United States Patent [19]

Damusis et al.

[11] 4,162,569

[45] Jul. 31, 1979

[54] METHOD OF MAKING METAL GASKETS

[75] Inventors: John A. Damusis, Cicero; Sam M. Rageb, Franklin Park, both of Ill.

[73] Assignee: Dana Corporation, Toledo, Ohio

[21] Appl. No.: 842,723

[22] Filed: Oct. 17, 1977

[51] Int. Cl.[2] ..... B23P 17/00

[52] U.S. Cl. ..... 29/417; 29/512; 72/339

[58] Field of Search ..... 29/417, 512, 557, 558; 72/70, 72, 335, 339, 348, 367; 83/25, 42, 54; 10/72 R, 86 B, 86 F

[56] References Cited

U.S. PATENT DOCUMENTS

| | | | |
|---|---|---|---|
| 76,797 | 4/1908 | Morse | 72/338 |
| 1,243,005 | 10/1917 | Taylor | 72/324 |
| 1,610,383 | 12/1926 | Johnson | 29/417 |
| 1,748,582 | 2/1930 | Oven | 277/231 |
| 1,872,276 | 8/1932 | Graham | 72/324 |
| 2,213,040 | 8/1940 | Drissner | 29/417 |
| 2,379,584 | 7/1945 | Litton | 72/71 |
| 2,907,101 | 10/1959 | Hamm | 29/156.62 |
| 2,983,033 | 5/1961 | Cox | 29/159.01 |
| 3,153,990 | 10/1964 | Kunzog | 92/169 |
| 3,336,659 | 8/1967 | Staples et al. | 29/512 |
| 3,369,388 | 2/1968 | Jepson | 72/367 |
| 3,857,156 | 12/1974 | Clark | 29/417 |

*Primary Examiner*—Michael J. Keenan

*Attorney, Agent, or Firm*—Wilson, Fraser & Clemens

[57] ABSTRACT

A method of forming metal gaskets from a predetermined length of metal tubing.

2 Claims, 13 Drawing Figures

METHOD OF MAKING METAL GASKETS

BACKGROUND OF THE INVENTION

One of the well known and accepted methods of forming gasket elements has been by blanking or stamping the elements from flat sheets of material and then forming the stamped blanks to the desired shapes. Manifestly, in forming annular gasket elements, such operations have resulted in considerable material loss and scrap.

It will be clearly apparent that when gasket elements are formed of expensive materials, for example stainless steel, the waste of the metal is very expensive and adds considerably to the cost of the finished product.

Accordingly, it is an object of the present invention to produce a gasket element by a method which is considerably more economical than the known methods.

Another object of the invention is to produce a gasket element from commercially available tubular stock whereby the waste through material loss and scrap is substantially reduced.

Still another object of the invention is to produce a gasket element by a method employing a minimum number of manipulative steps.

SUMMARY OF THE INVENTION

The above, as well as other objects of the invention may be typically achieved by producing a gasket by initially providing a length of tubing; and forming and severing the end portion of a predetermined length of the tubing to provide a pair of joining walls at angles to one another.

BRIEF DESCRIPTION OF THE INVENTION

The objects and advantages of the invention will become readily apparent to those skilled in the art from reading the following detailed description of preferred embodiments of the invention when considered in the light of the accompanying drawings, in which.

DESCRIPTION OF PREFERRED EMBODIMENT

Figure 1:
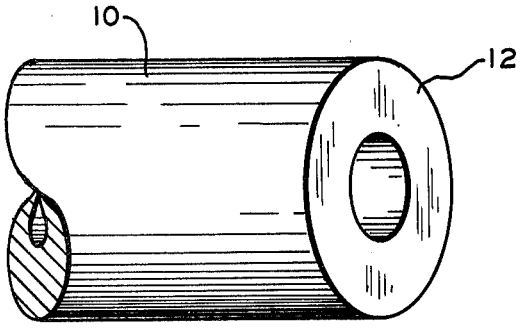
FIG. 1 is a fragmentary perspective view of tubular stock of relatively thick walled dimensions used in forming gasket elements in accordance with the invention.
Figure 2:
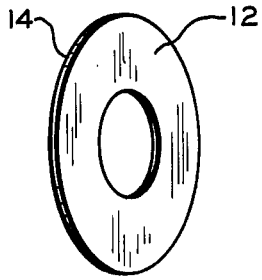
FIG. 2 is a perspective view of a predetermined length of tubing removed from the tubular stock illustrated in FIG. 1.
Figure 3:
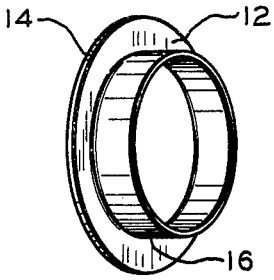
FIG. 3 is a perspective view of a gasket formed from the material illustrated in FIG. 2.

Referring to the drawings and particularly FIGS. 1, 2 and 3, there is illustrated a tube 10 preferably of a metallic composition having a relatively thick wall and an exposed substantially planar end face. The tubing cam is welded or seamless tubing or pipe which is readily and commercially available. An initial step in making the end product or gasket is to cut a washer shaped element illustrated in FIG. 2 having a relatively thin annular side wall 14. The cutting or severing of the washer from the end face 12 of the tube 10 may be accomplished by any of the known methods such as a metal saw. Also, laser beam cutting techniques could be satisfactorily employed.

After the severing of the washer shaped element of FIG. 2, the element is placed in a suitable die assembly wherein the punch portion of the assembly is effective to force a portion of the metal of the washer adjacent the inner circumferential edge thereof outwardly to form a substantially cylindrically shaped extension or overlap 16. It will be appreciated that the axis of the overlap 16, in the illustrated embodiment of FIG. 3, is substantially perpendicular to the plane of the end face 12. However, depending upon the configuration of the shaping die assembly, the relationship of the axis of the extension and the plane of the face could be other than perpendicular to one another. Also, the end face 12 of the tube 10 could be caused to be bent so that the thin annular side wall 14 extended inwardly instead of outwardly as illustrated.

Figure 12:
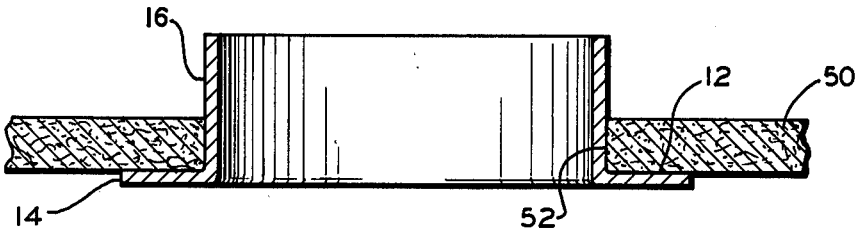
FIG. 12 is a fragmentary sectional view of a gasket element as illustrated in FIG. 3 being formed as a seal about the periphery of an aperture formed in an associated sheet of gasket material.
Figure 13:
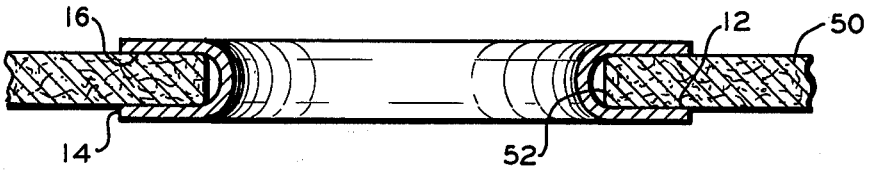
FIG. 13 is a fragmentary sectional view of the completed composite gasket following the steps illustrated in FIG. 12.

The product of FIG. 3 is typically utilized as a gasket element used as a seal in a finished composite gasket of the type illustrated and described with respect to FIGS. 12 and 13. The procedure forming the gasket element lends itself to economical mass production where the commercially available thick-walled tubing may be continuously fed into a cut-off station for automatically cutting off the washer-like elements which are subsequently formed at another station into the intermediate product illustrated in FIG. 3. The elimination of any waste to speak of makes possible the use of relatively expensive metals which were deemed too expensive to use to form gaskets with the prior blanking process which produced a considerable amount of waste.

Figure 4:
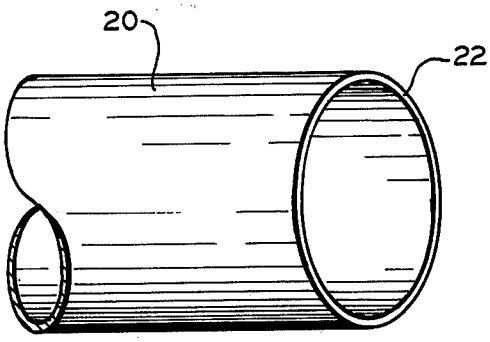
FIG. 4 is a fragmentary perspective view similar to FIG. 1 showing relatively thin walled tubular stock used in forming a gasket element in accordance with the invention.
Figure 5:
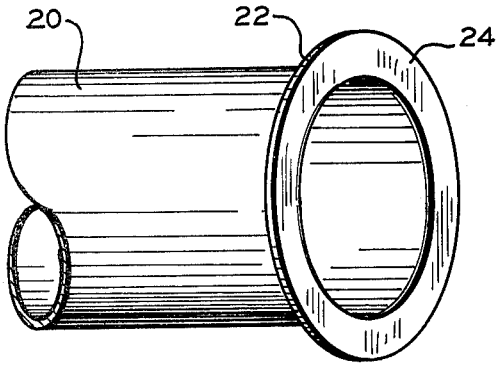
FIG. 5 is a fragmentary perspective view of tubular stock illustrated in FIG. 4 after a flange has been formed thereon.
Figure 6:
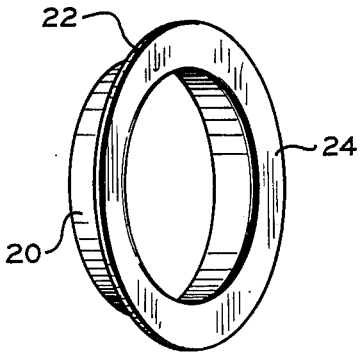
FIG. 6 is a perspective view of the completed gasket element formed from the tubular stock illustrated in FIGS. 4 and 5.

Another embodiment of the invention as illustrated in FIGS. 4, 5, and 6 wherein there is shown an end portion of a tube 20 preferably of a metallic composition having a relatively thin wall and an exposed substantially planar face end face 22. The tubing 20 is of a welded or seamless type tubing or pipe which is readily and commercially available. The initial step in forming the gasket element illustrated in FIG. 6 is to shape the end of the tubing 20 by spinning, for example, to form a flange or heel 24. The flange 24 is illustrated as extending radially outwardly, but it must be understood that the same procedure could be modified to cause the flange to extend radially inwardly.

Finally, the finished product, the gasket element illustrated in FIG. 6, is formed by severing the tube 20 at the desired length inwardly of the flange 24. As in the formation of the product illustrated in FIGS. 1, 2, and 3; the product of FIGS. 3, 4, 5 is produced with virtually no scrap, thereby amounting to considerable savings in material over the blanking process.

Figure 7:
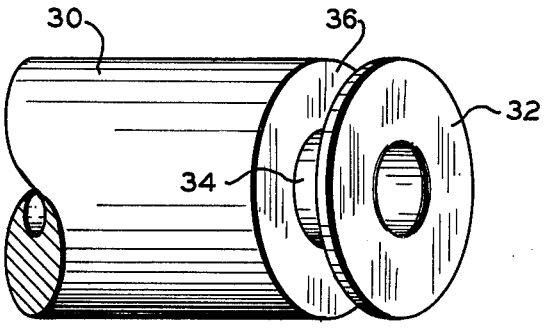
FIG. 7 is a fragmentary perspective view of a relatively thick walled tubular stock of the type illustrated in FIG. 1 illustrating the steps of removing a portion of the stock of the wall thereof prior to severing the final gasket from the stock.
Figure 8:
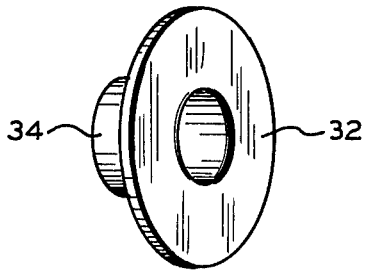
FIG. 8 is a perspective view of a gasket after being severed from the tubular stock illustrated in FIG. 7.

Referring to FIGS. 7 and 8, there is illustrated a method of producing a gasket element by employing a rather thick walled tubing 30 having a planar end face 32. Initially, the cylindrical portion of the material is removed to form a cylindrical section or overlap 34 of reduced outside diameter. The material of the tubing 30 can be removed to form the reduced diameter cylindrical portion 34 by the utilization of a laser or electron beam, or with conventional automatic tube cutting machines and tools, automatic tube cutting lathes, diamond wire cutting machines, or electric discharge machines.

When the desired outside dimension of the cylindrical portion or overlap 34 is reached, the innermost circumferential portion thereof adjacent the newly formed surface 36 of the tubing 30 is caused to be severed from the tubing 30 by any of the above noted techniques. Upon the completion of the severing operation, the gasket element illustrated in FIG. 8 is formed. It will be appreciated that the minimum dimensions of the finished product will depend to a large part on the particular material of which the tubing 30 is comprised and the type of material working or cutting technique employed. Obviously, if the electron beam or laser technique is employed, there will be a myriod of attendant advantages. Among these advantages is that there will be no cutting tools to wear or to replace. There is no necessity of employing special tools on the part being worked or the associated lathe equipment. The cutting rate can be readily varied by varying the speed of the associated turning lathe, or varying the beam power of feed rate. Furthermore, the quality of the machinery can be varied by varying the beam parameters. Also, it will be understood that the size or shape of the machined cut can be varied by changing the beam diameter or the angle with which the beam contacts the work. Since the electron beam or laser beam techniques cause a heating of the part being machined, and, therefore, case hardening of the part could be achieved at the same time the machining is being accomplished. A by-product of such machining technique is that the evaporated metal can be readily collected for recycling. The exhausted beam projecting to the opposite side of the part being machined, could be utilized as a heat source for other uses. Finally, since the above technique does not involve the application of pressure on the work piece, cutting into flexible materials or materials with low strength or small thickness is also possible.

Figure 9:
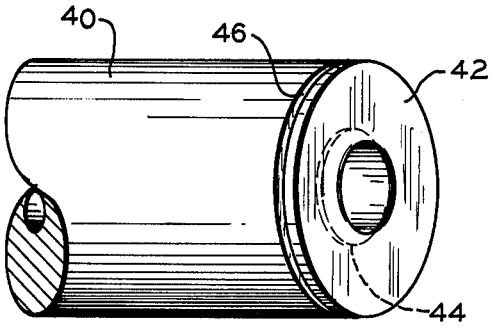
FIG. 9 is a fragmentary perspective view of a relatively thick walled tubular stock of the type illustrated in FIGS. 1 and 7 illustrating the step of removing a relatively thin section of the stock of the wall thereof prior to forming the completed gasket.
Figure 10:
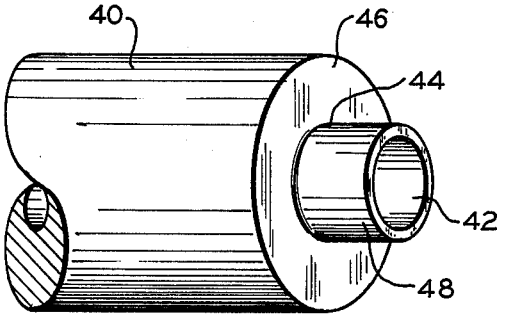
FIG. 10 is a fragmentary sectional view of the tubular stock illustrated in FIG. 9 showing the formation of the cylindrical section thereof.
Figure 11:
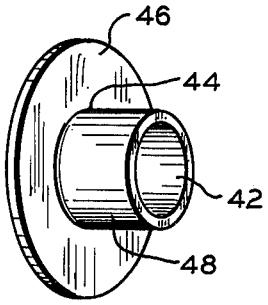
FIG. 11 is a perspective view of the completed gasket made in accordance with the steps illustrated in FIGS. 9 and 10 after being severed from the tubular stock.

FIGS. 9, 10 and 11 illustrate another embodiment of the method described above wherein a relatively thick walled tube 40 having a planar end face 42 has a relatively thin section removed therefrom by any of the above referred to machining techniques. The material thus removed creates an inner cylindrical section 44 of reduced diameter and a newly formed tube end face 46. The material remaining which includes the tube end face 42 is caused to be bent outwardly and inwardly, typically by spinning operation, to assume the cylindrical shape or overlap as illustrated in FIG. 10. The newly formed cylindrical wall or overlap 48 is of the same outside diameter as the outside diameter of the cylindrical section 44.

Finally, the shaped gasket element comprised of the cylindrical wall or overlap 48 and the tube end face or heel 46 is severed from the tube 40 by cutting the tube 40 a predetermined distance inwardly of the end face 46 to form the element illustrated in FIG. 11.

The gasket elements illustrated in FIGS. 3, 6, 8, and 11 are, in effect, intermediate elements employed in the manufacture of composite gasket elements of the type which may employ a sheet of asbestos, for example. The final composite gasket element is illustrated in FIGS. 12 and 13. In FIG. 12 there is shown sheet 50 of gasket material such as abestos for example having at least one aperture 52 formed therein. The overlap 16 of the element illustrated in FIG. 3 is inserted so as to extend through the aperture 52. The overlap 16 is of sufficient length to extend through the aperture 52 and extend beyond the upper surface of the sheet 50 an amount to permit the distal end portion thereof to be bent outwardly and downwardly to form a complete annular seal for the aperture 52 as illustrated in FIG. 13.

In conclusion, it will be appreciated that the formation of the gasket elements by the methods described above achieve one of the important objects of the invention to reduce loss of material through scrap. Scrap material is reduced to a minimum by practicing the methods outlined above.

In accordance with the provisions of the patent statutes, the principle and mode of operation of the invention have been explained in what is considered to represent its best embodiments which have been illustrated and described. It should, however, be understood that the invention may be practiced otherwise than as specifically illustrated and described without departing from its spirit or scope in accordance with the attached claims.

What we claim is:

1. A method of making flanged gasket elements including the steps of:

providing a length of metal tubing;

initially working the end portion of said tubing by the removal of a quantity of material from the peripheral side wall of said tubing to form a wall lying in a plane substantially perpendicular to the axis of said tubing and bending the wall lying in the plane perpendicular to the axis of said tubing; and removing a predetermined length of said tubing including the end portion from said tubing.

2. The method defined in claim 1 including the further steps of inserting the bent portion of the remaining metal into an aperture in a sheet of gasket material causing a portion thereof to extend through the aperture; and bending the portion of the metal extending through the aperture to seal around the edge of the aperture.

* * * * *